US006354047B1

(12) United States Patent
Shimoda et al.

(10) Patent No.: US 6,354,047 B1
(45) Date of Patent: Mar. 12, 2002

(54) COLUMNAR STRUCTURE WITH EARTHQUAKE RESISTANCE IMPARTED THERETO AND METHOD OF REINFORCING THE EARTHQUAKE RESISTANCE OF A COLUMNAR STRUCTURE

(75) Inventors: Ikuo Shimoda, Tokyo; Hideo Moritaka, Osaka, both of (JP)

(73) Assignee: Oiles Corporation, Tokyo (JP)

( * ) Notice: Subject to any disclaimer, the term of this patent is extended or adjusted under 35 U.S.C. 154(b) by 0 days.

(21) Appl. No.: 09/704,826

(22) Filed: Nov. 3, 2000

(30) Foreign Application Priority Data

Oct. 21, 1998 (JP) ..... 10-299419

(51) Int. Cl.[7] ..... E04B 1/98
(52) U.S. Cl. ..... 52/167.1; 52/167.2; 52/167.7
(58) Field of Search ..... 52/167.1, 167.2, 52/167.7

(56) References Cited

U.S. PATENT DOCUMENTS 2,690,074 A * 9/1954 Jones ..... 52/167.1
5,732,802 A * 3/1998 Tsukagoshi ..... 52/167.1 X
6,141,919 A * 11/2000 Robinson ..... 52/167.7

FOREIGN PATENT DOCUMENTS

| | | |
|---|---|---|
| JP | 54-28226 | 9/1979 |
| JP | 2-1947 | 1/1990 |
| JP | 10-46865 | 2/1998 |
| JP | 2000-73607 | 3/2000 |
| JP | 2000-73612 | 3/2000 |

* cited by examiner

*Primary Examiner*—Carl D. Friedman
*Assistant Examiner*—Brian E. Glessner
(74) *Attorney, Agent, or Firm*—Nixon & Vanderhye

(57) ABSTRACT

A first plate member and a second plate member are attached to a column member in such a manner as to be capable of undergoing relative displacement, and a viscoelastic material is disposed fixedly between the two plate members. As an alternative arrangement, a casing and a plate member inserted in the casing are attached to the column member in such a manner as to be capable of undergoing relative displacement, and a viscous material is filled in the casing. Drag occurs with respect to the plate member in conjunction with the vibration of the column member, thereby damping a structure.

9 Claims, 10 Drawing Sheets

COLUMNAR STRUCTURE WITH EARTHQUAKE RESISTANCE IMPARTED THERETO AND METHOD OF REINFORCING THE EARTHQUAKE RESISTANCE OF A COLUMNAR STRUCTURE

BACKGROUND OF THE INVENTION

1. Field of the Invention

The present invention relates to a columnar structure such as a column member of a building structure or a bridge pier, an abutment, and the like of a bridge structure, and more particularly to an earthquake-resistant columnar structure in which earthquake resistance is imparted to the columnar structure and a method of reinforcing the earthquake resistance of a columnar structure.

2. Description of the Related Art

Conventionally, the following countermeasures for reinforcing earthquake resistance are generally adopted for buildings which lack aseismic performance so as to increase their earthquake resistance.

(1) Countermeasures for increasing the thickness of earthquake-resistant walls which lack wall thickness.

(2) Countermeasures for reinforcing columns such as by wrapping peripheries of the columns with steel plates, carbon fibers, or the like.

(3) Countermeasures for newly or additionally installing braces between two adjacent columns.

However, with these so-called earthquake-resistance increasing methods (1), (2), and (3), a large installation space is required to ensure sufficient earthquake resistance, while, on the other hand, the weight increases substantially due to the added members involved in the reinforcement, so that the above-described countermeasures do not necessarily improve the earthquake resistance effectively.

Meanwhile, in recent years, a base isolation method for absorbing vibrational energy consequent upon the shaking of a building by interposing so-called interlayer dampers between layers of the building has come to be adopted as an earthquake-resistant measure for buildings. The interlayer dampers used in this base isolation method include (a) a wall-like damper which makes use of the viscous shearing force and (b) a cylinder-like damper interposed between a PC wall or a brace and a column or a beam (a lead-extruded damper, an oil damper, and the like).

In contrast to the fact that the aforementioned countermeasures (1) to (3) counteract the seismic force by simply increasing the strength, this base isolation method is based on a dynamic design in which the response of a building is suppressed by absorbing the seismic energy intentionally, consequently reducing the seismic force acting on the columns and walls. Hence, the base isolation method is a rational and effective earthquake-resistant measure.

However, although the base isolation method using the interlayer dampers do not present a problem when the interlayer dampers are incorporated in advance at the time of newly constructing a building, the repair of wall members is unavoidable when the interlayer dampers are installed in an existing building. Hence, the problem of the installation space occurs in the same way as the aforementioned methods (1) to (3), and has been a bottleneck to the introduction of the base isolation method.

SUMMARY OF THE INVENTION

The present invention has been devised in view of the above-described circumstances, and its object is to overcome the problem of the installation space, which has been the bottleneck, without repairing the wall members in the introduction into an existing building of the base isolation method using the interlayer dampers exhibiting excellent vibration controlling characteristics To this end, in the present invention, the above-described problem is resolved by adopting the new concept that the interlayer damper is fitted to a column member of a building. Another object of the present invention is to develop an interlayer damper which is fitted to a column member of a building.

Specifically, the following arrangements are adopted in the present invention:

Namely, in accordance with a first aspect of the invention, there is provided a columnar structure with earthquake resistance imparted thereto, the columnar structure having a polygonal cross section and adapted to support a load, comprising: a damping structural member attached to a side surface of the columnar structure, the damping structural member including a planarly rigid first plate member formed in the shape of a flat plate and having one end fixed to an upper portion of a columnar member and another end set as a free end, and a planarly rigid second plate member formed in the shape of a flat plate and having one end fixed to a lower portion of the columnar member and another end set as a free end, the first plate member and the second plate member being disposed in such a manner as to oppose each other with a predetermined interval therebetween, wherein a viscoelastic material capable of maintaining a solid shape is disposed between the first plate member and the second plate member, and is as a whole fixed to the first plate member and the second plate member.

In the above-described arrangement, as for the first plate member and the second plate member, either one of them may be disposed on an inner side, the other one disposed on an outer side, and the positions of the first plate member and the second plate member are not restricted. In addition, the upper portion of the columnar member referred to herein does not exclude a ceiling surface in the vicinity of an upper portion of the columnar member within a range in which the damping structural member exhibits an equivalent function. As for the lower portion of the columnar member as well, a floor surface is not excluded in the same way. It should be noted that the cross section of the columnar structure refers to a cross section formed by envelopes on its outer sides, and an H-type cross section belongs to a quadrangular shape.

In accordance with a second aspect of the invention, there is similarly provided a columnar structure comprising: a damping structural member attached to the columnar structure, the damping structural member including a planarly rigid plate member (resistance plate) formed in the shape of a flat plate and having an upper end fixed to an upper portion of a columnar member and a lower end set as a free end, and a casing formed in the shape of a rectangular box, the plate member being received in an inner space of the casing while maintaining an allowable movable range, a low end of the casing being fixed to a lower portion of the columnar member, wherein each of both surfaces of the plate member and each of both inner wall surfaces of the casing oppose each other with a very small interval therebetween, and a viscous material is filled in the casing.

In the above-described arrangement, the upper portion of the columnar member referred to herein does not exclude a ceiling surface in the vicinity of an upper portion of the columnar member within a range in which the damping structural member exhibits an equivalent function. As for the lower portion of the columnar member as well, a floor surface is not excluded in the same way. It should be noted that the cross section of the columnar structure refers to a cross section formed by envelopes on its outer sides, and an H-type cross section belongs to a quadrangular shape.

In accordance with a third aspect of the invention, there is similarly provided a columnar structure comprising: a damping structural member attached to the columnar structure, the damping structural member being arranged such that a planarly rigid plate member is disposed at a predetermined interval with a wall surface of a columnar member, and has one end fixed to one of an upper portion and a lower portion of the columnar member and another end set as a free end, and a viscoelastic material capable of maintaining a solid shape is disposed between the plate member and the wall surface of the columnar member, and is as a whole fixed to the plate member and the wall surface of the columnar member.

In the above-described arrangement, the upper portion of the columnar member referred to herein does not exclude a ceiling surface in the vicinity of an upper portion of the columnar member within a range in which the damping structural member exhibits an equivalent function. As for the lower portion of the columnar member as well, a floor surface is not excluded in the same way. It should be noted that the cross section of the columnar structure refers to a cross section formed by envelopes on its outer sides, and an H-type cross section belongs to a quadrangular shape.

In the above-described first, second, and third aspects of the invention, as for the columnar structure, a column member of a building structure or a bridge pier and an abutment of a bridge structure are directly used as objects, but other columnar members are not to be excluded.

In addition, although a quadrangular columnar member is normally used as the columnar member, the columnar member may be triangular or another polygon having five or more sides and angles. Further, (1) whether the damping structural members are disposed on all of the four sides of the quadrangular column, (2) whether the damping structural members are disposed on two mutually opposing surfaces thereof, and (3) whether the damping structural members are disposed on two mutually adjacent surfaces thereof are selective matters.

In accordance with a fourth aspect of the invention, there is provided a method of reinforcing the earthquake resistance of a columnar structure, comprising the step of: attaching the damping structural member according to the first aspect of the invention to a side surface of the columnar structure so as to impart earthquake resistance to the columnar structure having a polygonal cross section and adapted to support a load.

In accordance with a fifth aspect of the invention, there is similarly provided a method of reinforcing the earthquake resistance of a columnar structure, comprising the step of: attaching the damping structural member according to the second aspect of the invention to a side surface of the columnar structure so as to impart earthquake resistance to the columnar structure having a polygonal cross section and adapted to support a load.

In accordance with a sixth aspect of the invention, there is similarly provided a method of reinforcing the earthquake resistance of a columnar structure, comprising the step of: attaching the damping structural member according to the third aspect of the invention to a side surface of the columnar structure so as to impart earthquake resistance to the columnar structure having a polygonal cross section and adapted to support a load.

(Operation)

In accordance with the first aspect of the invention, when the columnar member is subjected to bending deformation by receiving a forced vibrational force such as earthquake motion, the first plate member and the second plate member undergo relative displacements with respect to each other, and the damping viscoelastic material placed therebetween undergoes shearing deformation, so that the damping viscoelastic material absorbs the displacements by virtue of its internal damping capacity.

In accordance with the second aspect of the invention, when the columnar member is subjected to bending deformation by receiving a forced vibrational force such as earthquake motion, the plate member and the casing undergo relative displacements with respect to each other, and viscous shear resisting force is produced by the viscous material interposed between the plate surfaces of the two members. Hence, the drag is transmitted to the upper portion of the columnar member by the plate members, and is transmitted to the lower portion of the columnar member by the casing, thereby absorbing the seismic oscillations.

In accordance with the third aspect of the invention, when the columnar member is subjected to bending deformation by receiving a forced vibrational force such as earthquake motion, relative displacement occurs between the columnar member and the plate member, and the damping viscoelastic material placed therebetween undergoes shearing deformation, so that the damping viscoelastic material absorbs the displacement by virtue of its internal damping capacity.

The above and other objects, features and advantages of the present invention will become more apparent from the following detailed description of the invention when read in conjunction with the accompanying drawings.

DESCRIPTION OF THE PREFERRED EMBODIMENTS

Referring now to the accompanying drawings, a description will be given of the embodiments of a columnar structure with earthquake resistance imparted thereto as well as a method of reinforcing the earthquake resistance of a columnar structure.

First Embodiment

Figure 1:
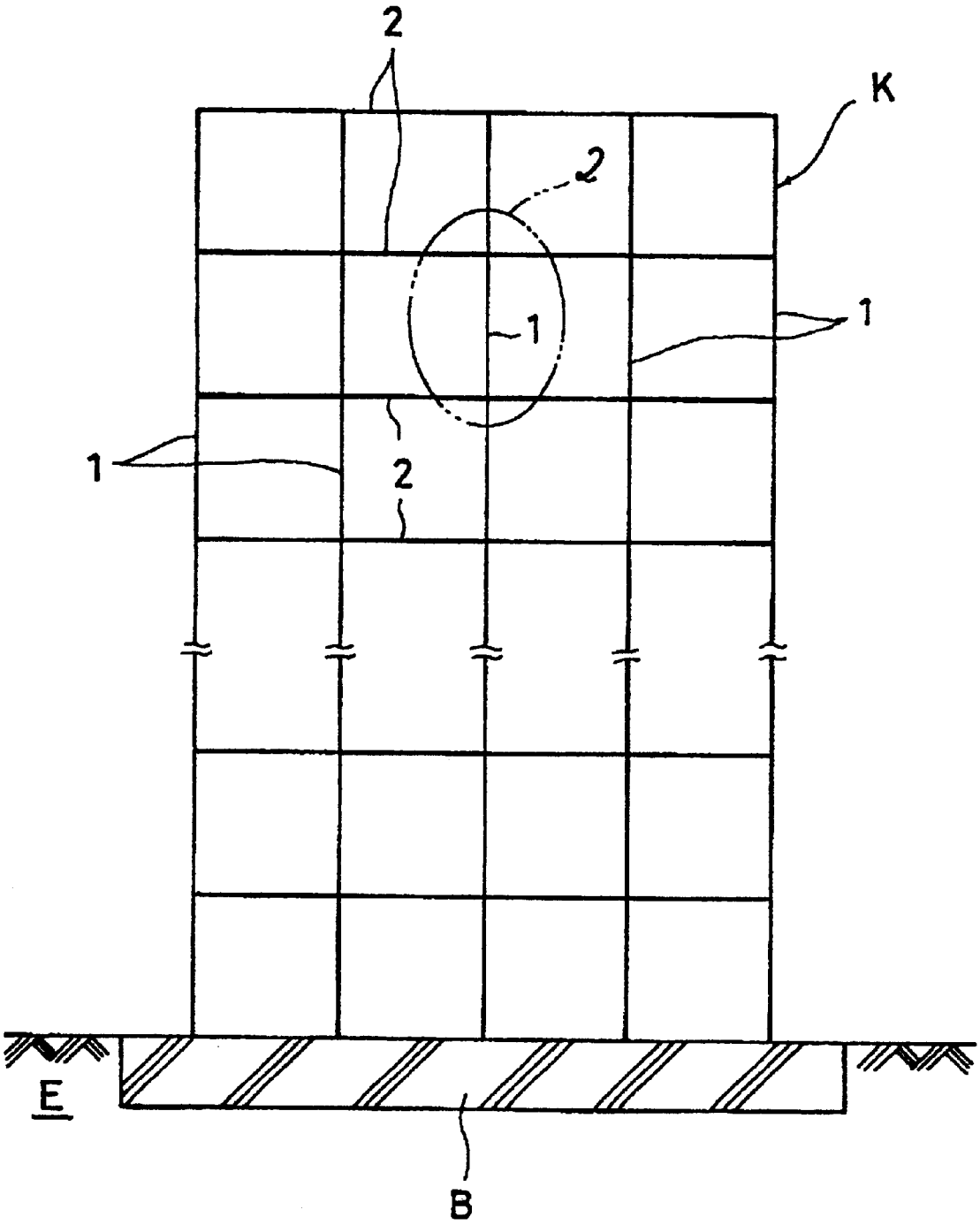
FIG. 1 is a schematic diagram illustrating an overall structure to which columnar structures with earthquake resistance imparted thereto in accordance with the invention are applied.
Figure 2:
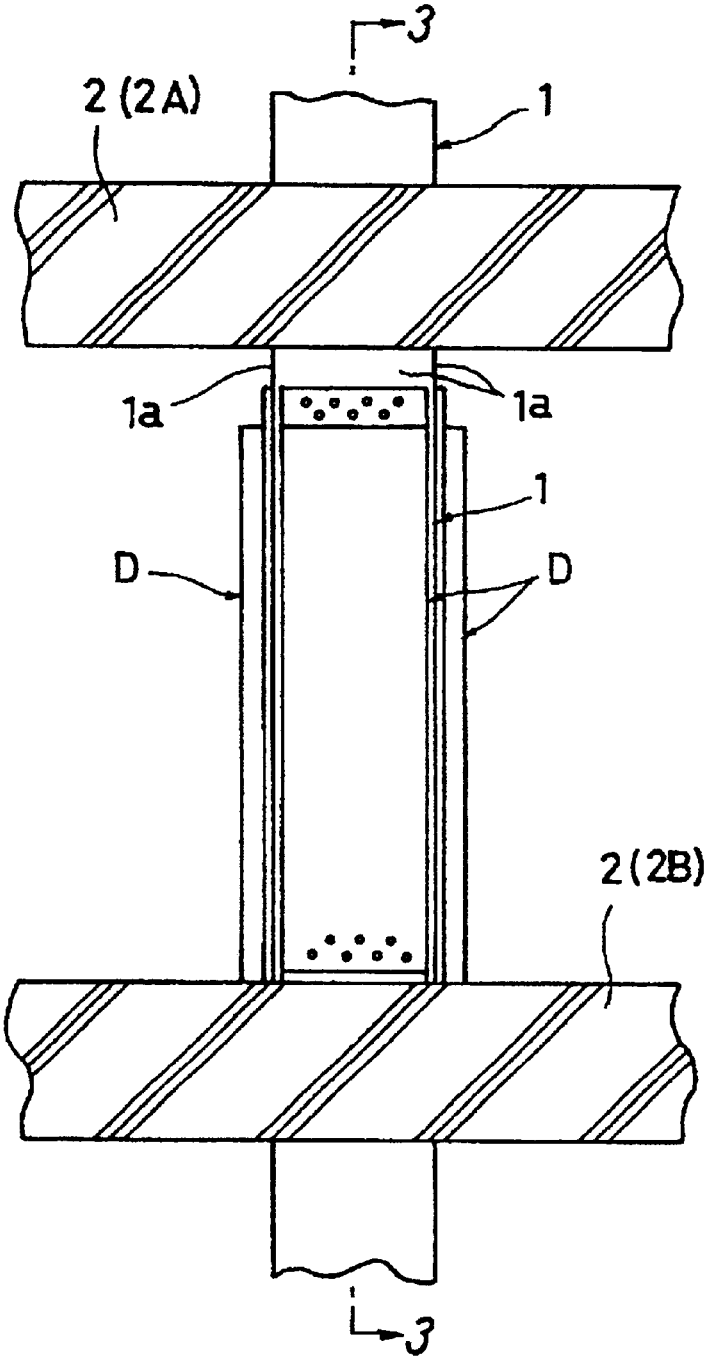
FIG. 2 is a side elevational view, partly in section, illustrating the overall columnar structure with earthquake resistance imparted thereto in accordance with an embodiment of the invention, and is a partly enlarged view of a portion 2 in FIG. 1.
Figure 3:
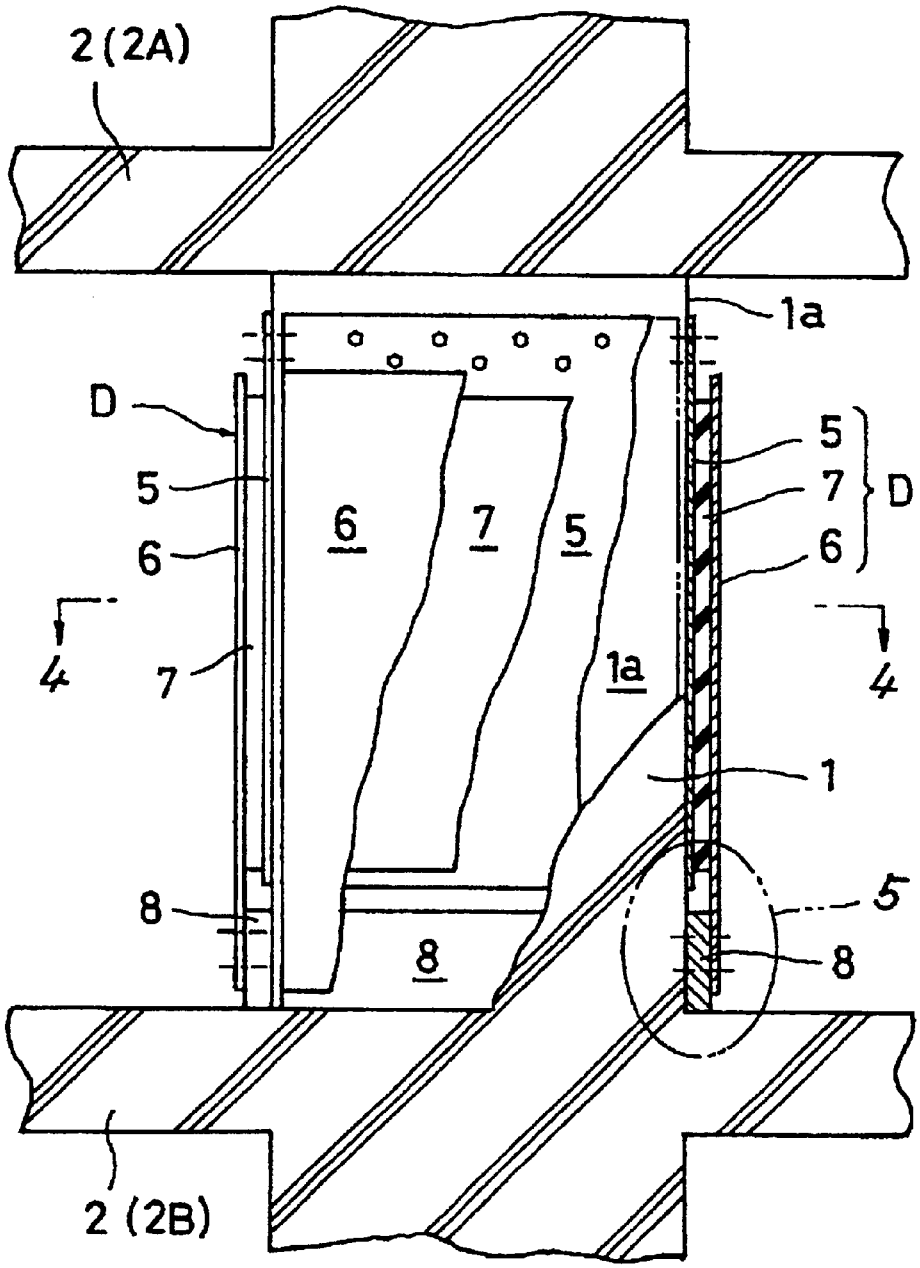
FIG. 3 is an enlarged cross-sectional view taken along line 3—3 in FIG. 2.
Figure 4:
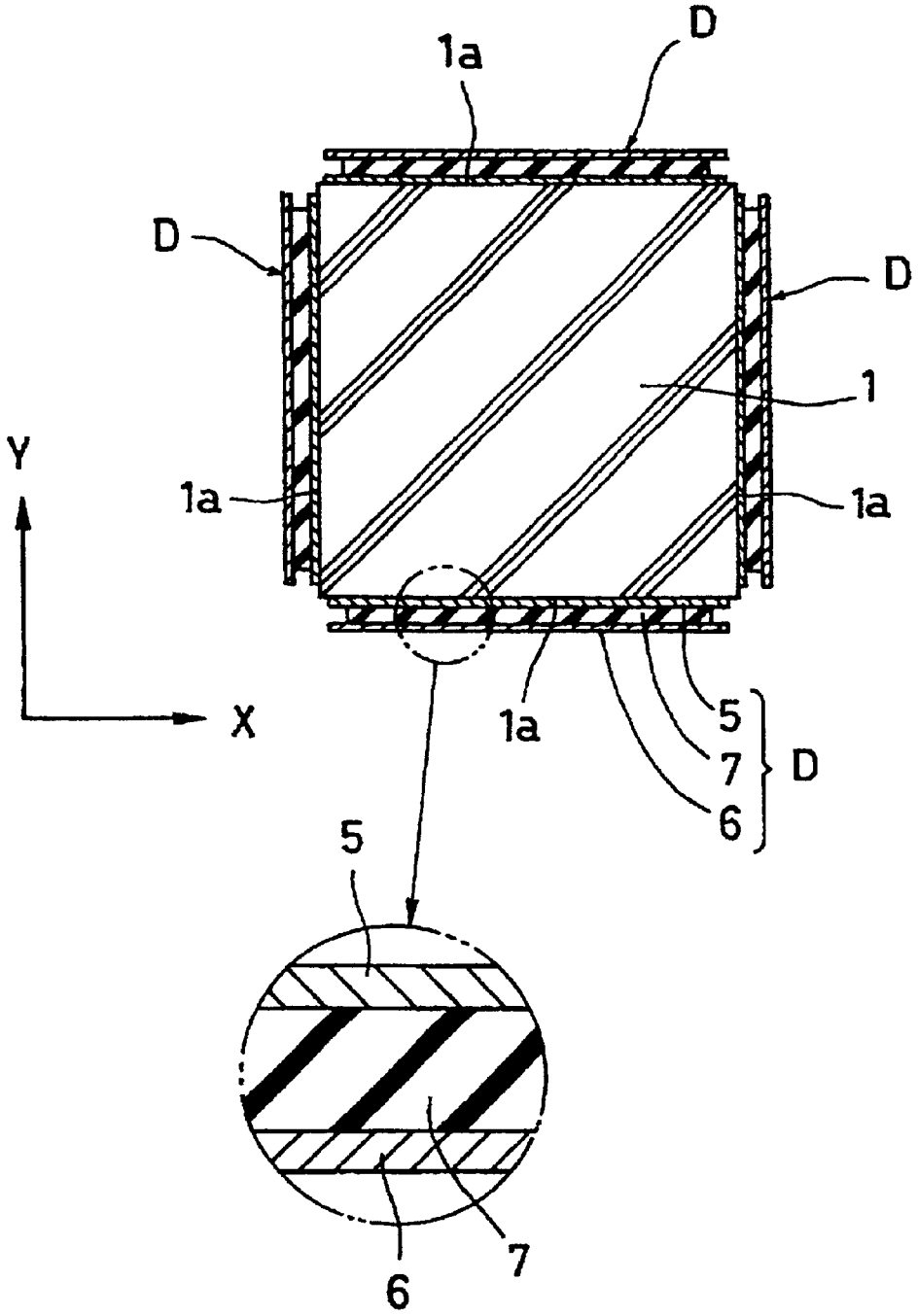
FIG. 4 is a cross-sectional view taken along line 4—4 in FIG. 3.
Figure 5:
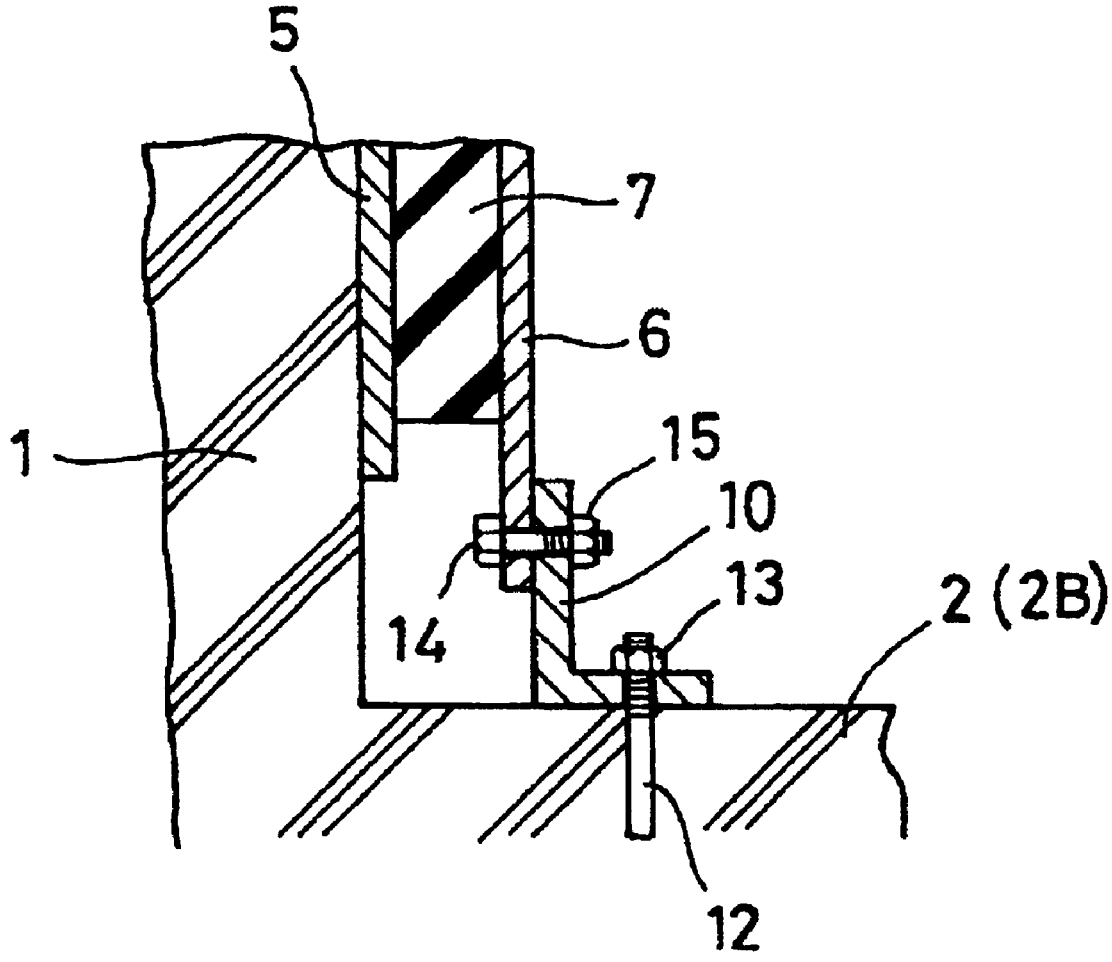
FIG. 5 is a diagram illustrating another form in which an outer plate in the embodiment is attached.

FIGS. 1 to 5 show one embodiment (first embodiment) of a columnar structure with earthquake resistance imparted thereto in accordance with the invention, and illustrate an example in which the invention is applied to a column member in a building structure. Namely, FIGS. 1 and 2 illustrate its overall configuration, and FIGS. 3 to 5 illustrate the configuration of its essential portions. In the drawings, reference character K denotes a multilayered building structure; B, a base; and E, the ground.

FIG. 1 illustrates the building structure K to which the invention is applied, and which adopts construction in which column members 1 and beam or floor members (hereafter referred to as the beam members) 2 are rigidly connected to each other at their points of contact. In each layer, reference numeral 2A denotes an upper beam member, and 2B denotes a lower beam member.

In this embodiment, damping structural members D are fitted to the respective surfaces of each column member 1.

Each damping structural member D includes: a flat inner plate 5 abutting against a column surface 1*a* of the column member 1 and having its upper end fixed to the column member 1; a flat outer plate 6 which is disposed at a predetermined interval with the inner plate 5 such that their plate surfaces oppose each other, and which has its lower end fixed to the column member 1; and a high damping rubber member 7 interposed between the aforementioned two plates 5 and 6 and serving as a viscoelastic material. The damping structural member D further includes an interposed member 8 for fixedly attaching the outer plate 6 to the column member 1.

Hereafter, a description will be given of the construction of the detailed parts.

Inner Plate 5

The inner plate 5 is formed of a hard material and has the shape of a rectangular flat plate which retains a fixed thickness and has rigidity. Although a steel material is generally used as the hard material, other materials such as reinforced rigid resin and the like are not excluded. The width of the inner plate 5 is set to be slightly smaller than the width of the column member 1.

This inner plate 5 abuts against the surface 1*a* of the column member 1, and its upper end portion is fixed to the column member 1 by fixing means (attaching bolts). Accordingly, the portion other than the upper end portion is held in such a manner as to slidably contact the column member 1, and is movable.

Outer Plate 6

The specifications (shape, thickness) and the material of the outer plate 6 are similar to those of the inner plate 5.

This outer plate 6 is disposed at a predetermined interval with the inner plate 5 such that their plate surfaces oppose each other, and its lower end is fixed to the column member 1 through the interposed member 8 interposed therebetween by the fixing means. Accordingly, the portion other than the lower end portion is relatively displaceable with respect to the column member 1.

Rubber Member 7

High damping rubber of a flat shape is used as the rubber member 7 in this embodiment, and both overall surfaces of the rubber member 7 are fixed to the inner plate 5 and the outer plate 6 in a sandwiched manner.

The rubber member 7 is formed of a high damping rubber composition.

The high damping rubber composition is formed by adding an additive exhibiting high damping properties to rubber materials including natural rubber, styrene-butadiene rubber (SBR), nitrile-butadiene rubber (NBR), butadiene rubber material (BR), isoprene rubber (IR), butyl rubber (IIR), halogenated butyl rubber (X-IIR), and/or chloroprene rubber (CR).

As the high damping rubber composition, it is possible to cite, among others, the following:

a. generally, one in which carbon black is added to the rubber materials;

b. one which contains 100 parts by weight of rubber components using natural rubber as their principal component and 70 parts by weight of silica as a filler;

c. one in which 15 parts by weight of cumarone indene resin is compounded with 100 parts by weight of rubber components which contain natural rubber and high styrene rubber at a ratio of 4/1; and d. acrylic resin.

This damping structural members D are respectively attached to the side surfaces 1*a,* i.e., the four surfaces, of the column member 1 in an identical structure. As a result, it is possible to cope with all the horizontal directions in the X and Y directions.

In this embodiment, although the outer plate 6 is attached to the column member 1 through the interposed member 8 interposed therebetween, it is possible to adopt a form in which the outer plate 6 is attached to the floor surface (lower beam member 2B). Further, as for the inner plate 5 as well, it is possible to adopt a form in which it is attached to a ceiling surface (upper beam member 2A).

FIG. 5 (corresponding to the portion 5 in FIG. 3) shows the form in which the outer plate 6 is attached to the floor surface, and the outer plate 6 becomes integral with the floor surface 2 (2B) by means of an attaching member 10 which is an angle bar. Namely, anchor members 12 embedded in the floor surface 2 are respectively inserted in anchor inserting holes in the attaching member 10, and the attaching member 10 is fixed by tightening a nut 13 on each anchor member 12. In addition, the attaching member 10 is fixed to the outer plate 6 by means of bolts 14 and nuts 15. In addition to this form, if a form is adopted in which the outer plate 6 is directly fixed to the floor surface, its effect remains the same. The attachment of the inner plate 5 to the ceiling surface is similar to the one described above, and the inner plate 5 is fixed thereto with or without an angle member.

(Operation and Advantages of This Embodiment)

Figure 6:
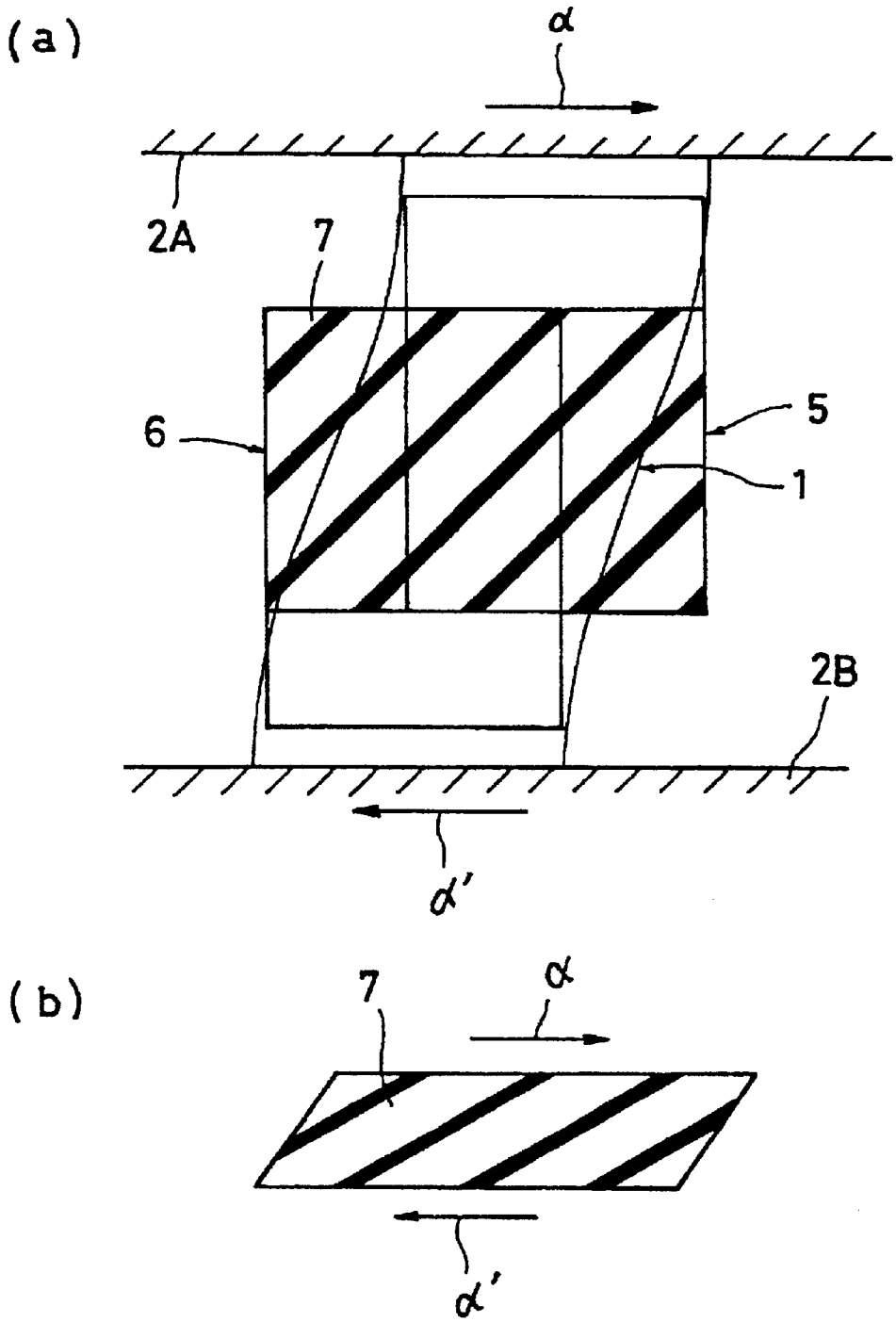
FIG. 6 is a diagram of action in this embodiment.
Figure 7:
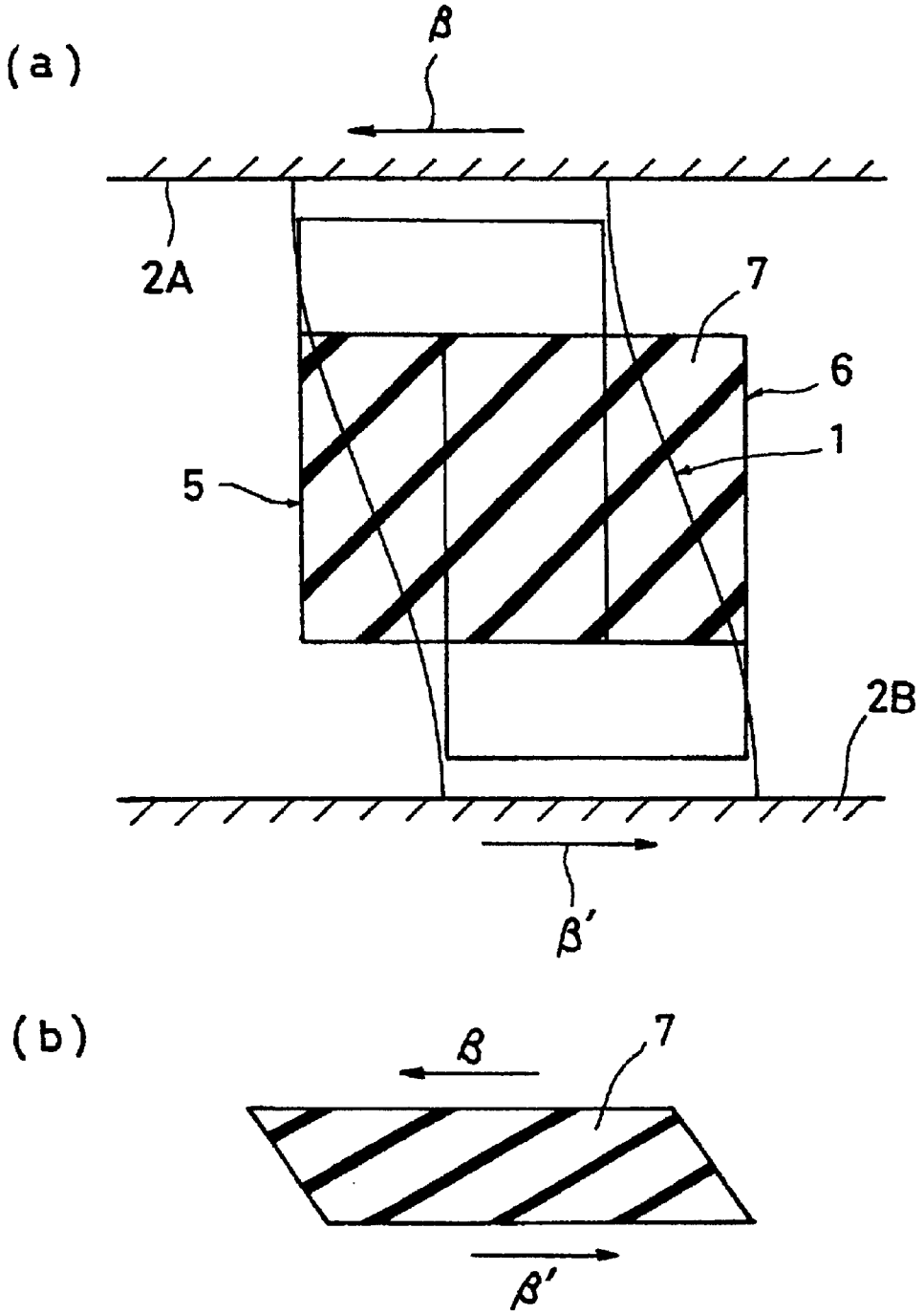
FIG. 7 is a diagram of action in this embodiment.

During the occurrence of an earthquake, the columnar structure having the damping structural members D in this embodiment exhibits the following damping action. Referring to FIGS. 6 and 7, a description will be given of its behavior.

When a forced vibrational force such as earthquake motion acts on the structure K, each layer of the framework undergoes shear deformation, and relative displacement occurs between the beam members 2A and 2B in the upper and lower layers, with the result that the column member 1 also undergoes bending deformation. Although this deformation is not necessarily large, FIGS. 6 and 7 show the deformation in enlarged form.

As shown in FIG. 6, when displacements in the directions of $\alpha$ and $\alpha'$ have respectively occurred in the beam members 2A and 2B, the inner plate 5 is displaced in the rightward direction in the drawing, the outer plate 6 is displaced in the leftward direction, and the rubber member 7 therebetween undergoes shear deformation. The rubber member 7 absorbs the displacements by virtue of its internal damping capacity.

As has already been clarified as the high damping rubber characteristics, the damping function of the rubber member 7 shows a hysteresis characteristic (load-displacement curve) having a large area, and exhibits large energy absorbing action.

Next, as shown in FIG. 7, when the displacements of the beam members 2A and 2B have respectively shifted to the directions of β and β', the inner plate 5 is displaced in the leftward direction in the drawing, the outer plate 6 is displaced in the rightward direction, and the rubber member 7 therebetween undergoes shear deformation in a direction opposite to the previous one. The rubber member 7 absorbs the displacements by virtue of its internal damping capacity.

The vibration of the structure K is thus attenuated rapidly.

According to this embodiment, the damping structural members D, which are thin in terms of the total thickness combining the inner plate, the rubber member, and the outer plate, are fitted to the peripheries of the respective column members 1. Therefore, the damping structural members D can be installed only around the column members 1 without occupying much space between the column members 1, so that the installation space can be small. In addition, the interlayer damper function is demonstrated, dynamic analysis can be applied, and a large damping capacity is demonstrated with the areas of the rubber members. Further, as for the damping structural members D, since the rubber members 7 themselves have a restoring characteristic, a restoring device is not additionally required, and the restoring force of the rubber members 7 is added to the restoring force of the structure itself, thereby exhibiting a large restoring force.

Second Embodiment

Figure 8:
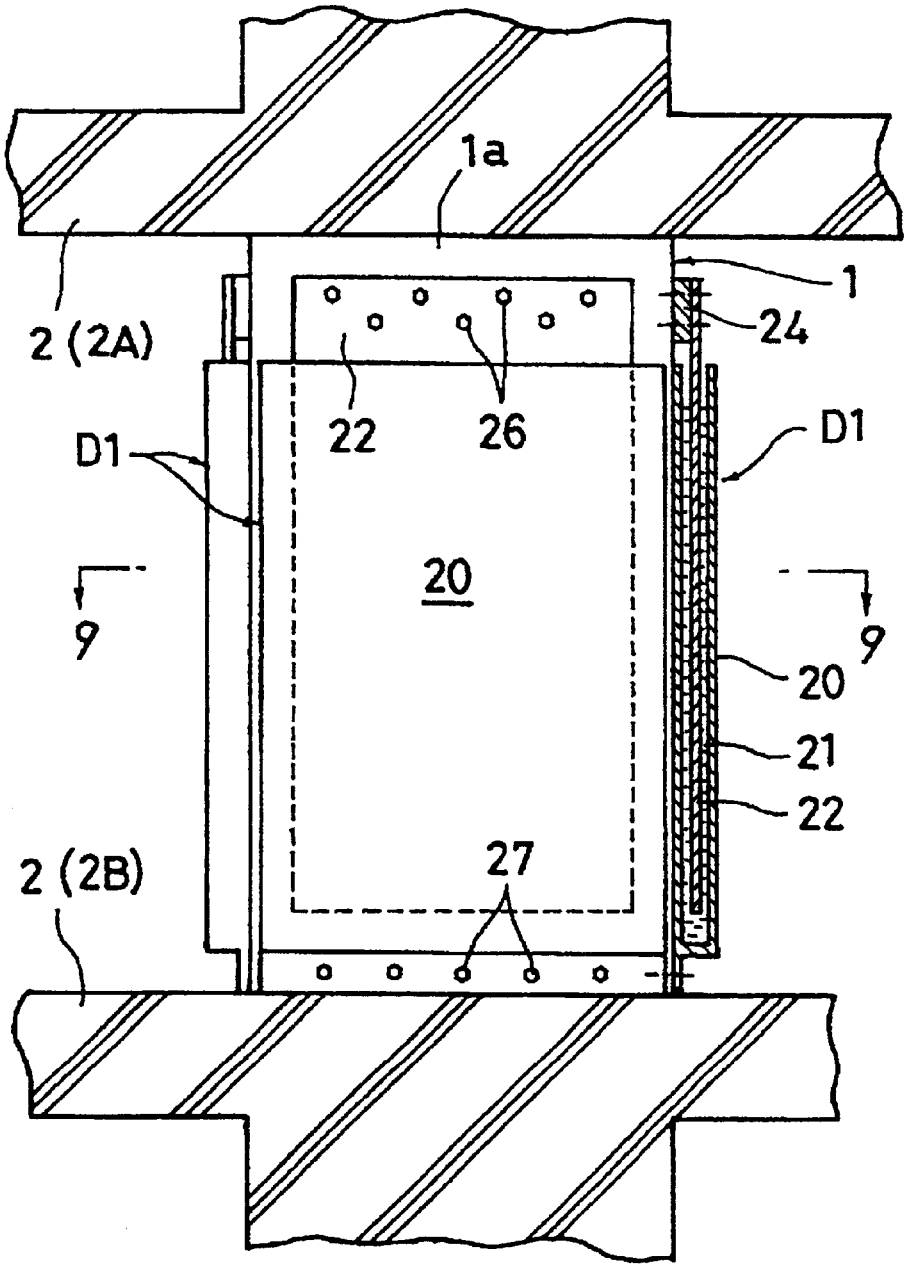
FIG. 8 is a side elevational view, partly in section, illustrating an overall columnar structure with earthquake resistance imparted thereto in accordance with another embodiment of the invention.
Figure 9:
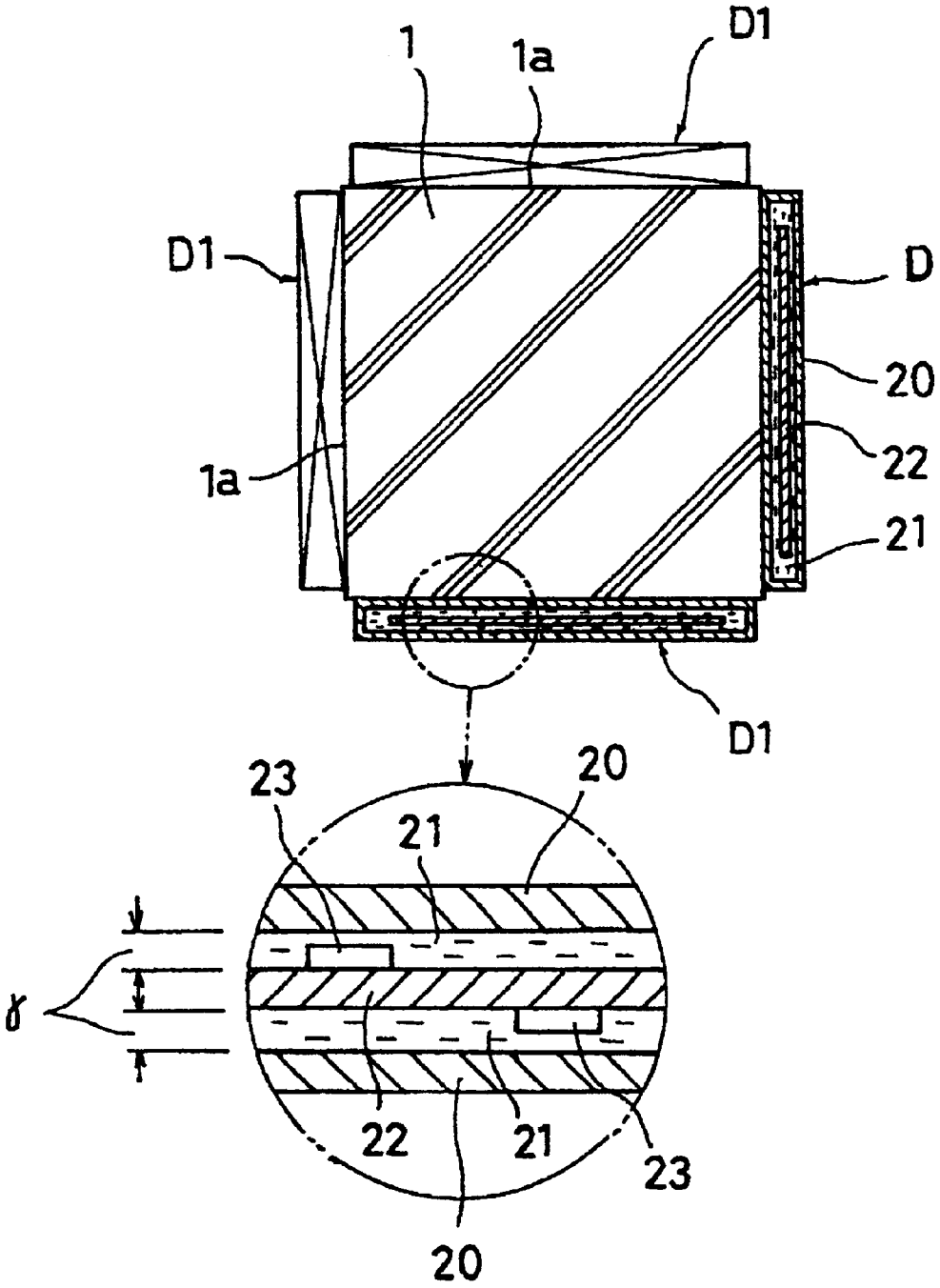
FIG. 9 is a cross-sectional view taken along line 9—9 in FIG. 8.

FIGS. 8 and 9 show another embodiment (second embodiment) of the columnar structure with earthquake resistance imparted thereto in accordance with the invention. In the drawings, members identical to those of the foregoing embodiment will be denoted by the same reference numerals.

In this embodiment, damping structural members D1 of the viscous shear type are respectively disposed on the side surfaces 1*a* of each columnar member 1.

Each damping structural member D1 includes: a rectangular box-shaped casing 20 which is upwardly open; a viscous material 21 filled in the casing 20; and a flat resistance plate 22 which is inserted in the casing 20. The damping structural member D1 further includes a spacer 23 which is interposed between the casing 20 and the resistance plate 22.

The casing 20 has its lower end fixed to a lower portion of the column member 1, while the resistance plate 22 has its upper portion fixed to an upper portion of the column member 1 by means of an interposed member 24.

More specifically, the casing 20 is formed in the shape of a vertically elongated thin container which has the shape of a rectangular parallelopiped and is upwardly open. The inner chamber of the container is narrow in width, and its inner wall surfaces are smooth. An outer wall surface of the casing 20 is made to abut against the wall surface 1*a* of the column member 1, and a lower end portion of the casing 20 is fixed to the column member 1 by means of fixing means 26.

As the viscous material 21, a high viscous material such as polyolefin, polysiloxane, or the like is used.

The resistance plate 22 is formed in the shape of a rectangular flat plate which has a fixed thickness and whose surfaces are flat and smooth. The resistance plate 22 is inserted in the casing 20 while maintaining a very small interval γ with respect to the inner surfaces of the casing 20 by virtue of spacers 23 attached to both surfaces of the resistance plate 22. The upper portion of the resistance plate 22 projects above the casing 20, and is fixed to the column member 1 with the interposed member 24 placed therebetween by using fixing means 27. A sufficient moving area is provided for the resistance plate 22. The resistance plate 22 is provided with a sufficient area to move in directions parallel to the planar surface of the resistance plate 22 in the lower portion and both side portions of the interior of the casing 20.

The columnar member with the damping structural members D1 attached thereto in accordance with this embodiment acts as follows.

When a forced vibrational force such as earthquake motion acts on the structure K, the framework undergoes shear deformation, and relative displacement occurs between the beam members 2A and 2B in the upper and lower layers, with the result that the column member 1 also undergoes bending deformation. The displacement of the column member 1 causes the resistance plate 22 of the damping structural member D1 to be displaced through the interposed member 24. The casing 20 is displaced in a direction opposite to that of the resistance plate 22. The resistance plate 22 undergoes relative displacement with respect to the inner wall surfaces of the casing 20 through the viscous material 21, and the resistance plate 22 is subjected to drag by the viscous shearing force occurring between the two surfaces, thereby absorbing the displacement of the column member 1 through the interposed member 24. The casing 20 also transmits drag to the column member 1 through its lower end portion. As a result, the vibrational displacement of the framework is rapidly absorbed.

In accordance with this embodiment, the damping structural members D1 are formed with small thickness in a manner similar to the first embodiment, and can be installed only around the column members 1, so that the installation space can be small.

Third Embodiment

Although, in the first embodiment, the rubber member 7 is clamped by and fixed to the inner plate 5 and the outer plate 6, as another embodiment a form is adopted in which the inner plate 5 is disused, and the rubber member 7 is directly fixed to the column surface 1*a* of the column member 1.

Namely, with the damping structural members in this embodiment (third embodiment), the outer plate 6 is disposed with a predetermined interval with respect to the column surface 1*a* of the column member 1, its upper portion or lower portion is fixed to the column member 1, and the rubber member 7 is clamped by and fixed to the column surface 1*a* of the column member 1 and the inner surface of the outer plate 6. The arrangement and the like of the damping structural members in this embodiment are similar to those of the first embodiment.

Figure 10:
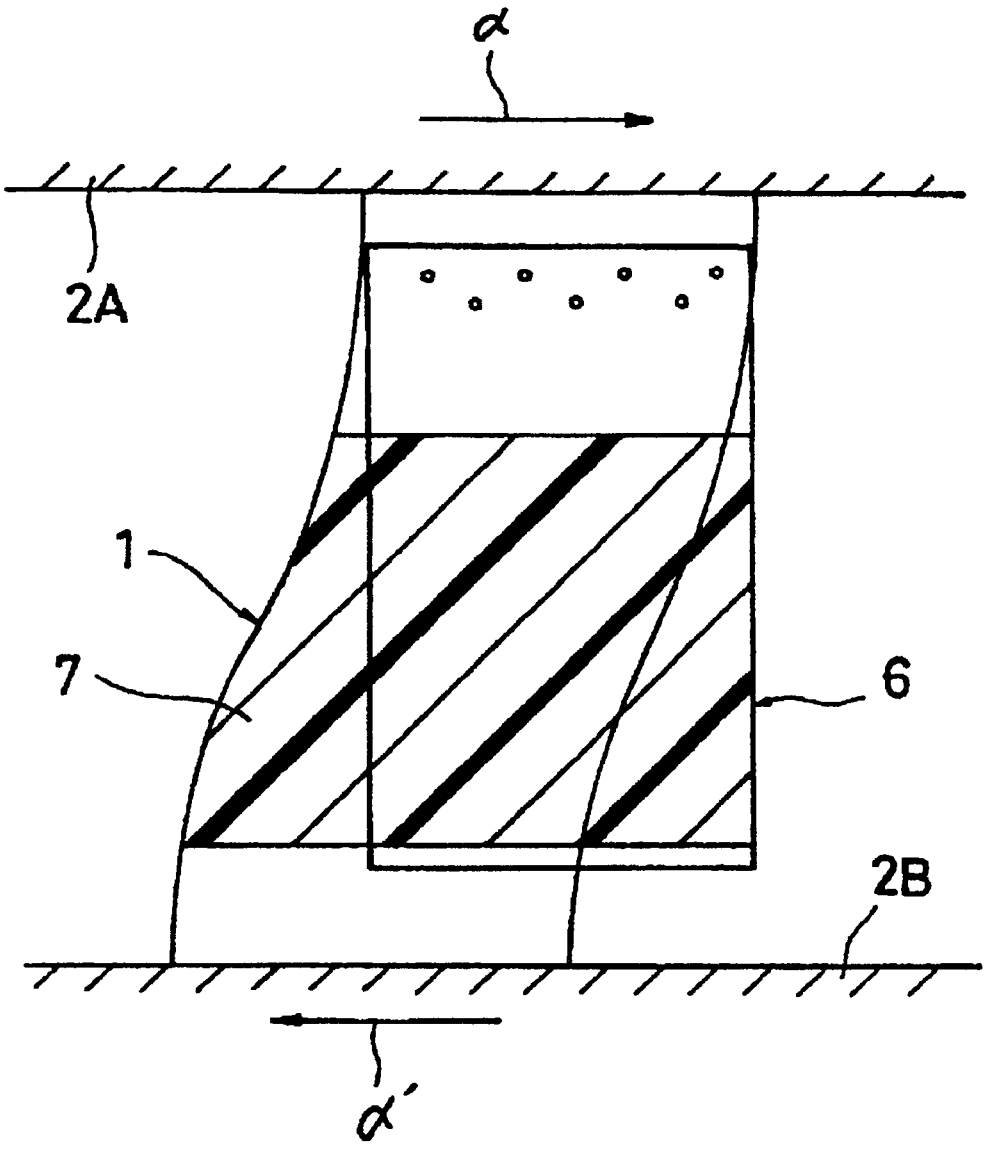
FIG. 10 is a diagram of operation of a columnar structure in accordance with still another embodiment of the invention.

FIG. 10 shows the action of the damping structural member in accordance with this embodiment. In this embodiment, the upper portion of the outer plate 6 is fixed. The outer plate 6 is independent of the bending deformation of the column member 1, and the rubber member 7 is subjected to shear deformation with respect to the bending deformation of the column member 1. In this case, the rubber member 7 does not undergo uniform deformation, and the closer to its free end portion, the larger the deformation.

Although, in the foregoing embodiments, a description has been given of the example in which the invention is applied to column members in the building structure K, the invention is also applicable to columnar members in a bridge structure, i.e., a bridge pier and an abutment. In this case, reinforced concrete-made elevated bridges of the rigid frame type as a bridge structure can be cited as preferable applications.

The present invention is not limited to the above-described embodiments, and various changes in design are possible within the scope of the basic technical concept of the invention. Namely, the following form is also included within the technical scope of the invention.

The rubber member used in the first embodiment may be of a laminated rubber type as a laminate composed of thin steel plates and high damping rubber layers.

In accordance with the columnar structure with earthquake resistance imparted thereto in the invention, the damping structural members exhibit the function of interlayer dampers and have large damping performance, and not only can an effective earthquake-resistance measure be provided, but rational design can be based on a dynamic theory. Moreover, in application to an existing structure, since it is sufficient to attach the damping structural members around the column members, and the repair of the wall members is not required, a substantial reduction of the installation cost can be attained.

What is claimed is:

1. A columnar structure with earthquake resistance imparted thereto, the columnar structure having a polygonal cross section and adapted to support a load, comprising:

a damping structural member attached to a side surface of said columnar structure, said damping structural member including a planarly rigid first plate member formed in the shape of a flat plate and having one end fixed to an upper portion of a columnar member and another end set as a free end, and a planarly rigid second plate member formed in the shape of a flat plate and having one end fixed to a lower portion of said columnar member and another end set as a free end, said first plate member and said second plate member being disposed in such a manner as to oppose each other with a predetermined interval therebetween, wherein a viscoelastic material capable of maintaining a solid shape is disposed between said first plate member and said second plate member, and is as a whole fixed to said first plate member and said second plate member.

2. A columnar structure with earthquake resistance imparted thereto, the columnar structure having a polygonal cross section and adapted to support a load, comprising:

a damping structural member attached to a side surface of said columnar structure, said damping structural member including a planarly rigid plate member formed in the shape of a flat plate and having an upper end fixed to an upper portion of a columnar member and a lower end set as a free end, and a casing formed in the shape of a rectangular box, said plate member being received in an inner space of said casing while maintaining an allowable movable range, a low end of said casing being fixed to a lower portion of said columnar member, wherein each of both surfaces of said plate member and each of both inner wall surfaces of said casing oppose each other with a very small interval therebetween, and a viscous material is filled in said casing.

3. A columnar structure with earthquake resistance imparted thereto, the columnar structure having a polygonal cross section and adapted to support a load, comprising:

a damping structural member attached to a side surface of said columnar structure, said damping structural member being arranged such that a planarly rigid plate member formed in the shape of a flat plate is disposed at a predetermined interval with a wall surface of a columnar member, and has one end fixed to one of an upper portion and a lower portion of said columnar member and another end set as a free end, and a viscoelastic material capable of maintaining a solid shape is disposed between said plate member and the wall surface of said columnar member, and is as a whole fixed to said plate member and the wall surface of said columnar member.

4. The columnar structure with earthquake resistance imparted thereto according to claim 1 or 2, wherein said columnar member has the shape of a quadrangular prism, and said damping structural member is disposed on each side surface of said columnar member.

5. The columnar structure with earthquake resistance imparted thereto according to claim 3, wherein said damping structural member is disposed on each of two mutually opposing surfaces of a quadrangular prism.

6. The columnar structure with earthquake resistance imparted thereto according to claim 3, wherein said damping structural member is disposed on each of two mutually adjacent surfaces of a quadrangular prism.

7. A method of reinforcing the earthquake resistance of a columnar structure having a polygonal cross section and adapted to support a load so as to impart earthquake resistance to the columnar structure, comprising the step of:

attaching a damping structural member to a side surface of said columnar structure, said damping structural member including a planarly rigid first plate member formed in the shape of a flat plate and having one end fixed to an upper portion of a columnar member and another end set as a free end, and a planarly rigid second plate member formed in the shape of a flat plate and having one end fixed to a lower portion of said columnar member and another end set as a free end, said first plate member and said second plate member being disposed in such a manner as to oppose each other with a predetermined interval therebetween, wherein a viscoelastic material capable of maintaining a solid shape is disposed between said first plate member and said second plate member, and is as a whole fixed to said first plate member and said second plate member.

8. A method of reinforcing the earthquake resistance of a columnar structure having a polygonal cross section and adapted to support a load so as to impart earthquake resistance to the columnar structure, comprising the step of:

attaching a damping structural member to a side surface of said columnar structure, said damping structural member including a planarly rigid plate member formed in the shape of a flat plate and having an upper end fixed to an upper portion of a columnar member and a lower end set as a free end, and a casing formed in the shape of a rectangular box, said plate member being received in an inner space of said casing while maintaining an allowable movable range, a low end of said casing being fixed to a lower portion of said columnar member, wherein each of both surfaces of said plate member and each of both inner wall surfaces of said casing oppose each other with a very small interval therebetween, and a viscous material is filled in said casing.

9. A method of reinforcing the earthquake resistance of a columnar structure having a polygonal cross section and adapted to support a load so as to impart earthquake resistance to the columnar structure, comprising the step of:

attaching a damping structural member to a side surface of said columnar structure, said damping structural member being arranged such that a planarly rigid plate member formed in the shape of a flat plate is disposed at a predetermined interval with a wall surface of a columnar member, and has one end fixed to one of an upper portion and a lower portion of said columnar member and another end set as a free end, and a viscoelastic material capable of maintaining a solid shape is disposed between said plate member and the wall surface of said columnar member, and is as a whole fixed to said plate member and the wall surface of said columnar member.

* * * * *